United States Patent [19]

Bolz

[11] Patent Number: 4,668,099

[45] Date of Patent: May 26, 1987

[54] CONICAL SPIRAL MIXER WITH SPHERICAL SEALING BODY IN THE BOTTOM OPENING

[76] Inventor: Alfred Bolz, Isnyer Strasse 76, D-7988 Wangen, Fed. Rep. of Germany

[21] Appl. No.: 776,751

[22] Filed: Sep. 16, 1985

[30] Foreign Application Priority Data

Apr. 11, 1985 [DE] Fed. Rep. of Germany ..... 3512887

[51] Int. Cl.[4] ..... B01F 7/30

[52] U.S. Cl. ..... 366/287; 277/71

[58] Field of Search ..... 366/287, 288, 314, 318, 366/205, 244, 279, 331; 277/30, 71, 3, 106, 70, 72 R, 72 FM, 75, 76; 464/132, 133, 173, 175, 7, 11

[56] References Cited

U.S. PATENT DOCUMENTS 3,775,863 12/1973 Updegrove ..... 366/287

4,437,767 3/1984 Hargis ..... 366/287

4,588,301 5/1986 Bolz ..... 366/287

FOREIGN PATENT DOCUMENTS 78793 8/1955 Netherlands ..... 366/287

*Primary Examiner*—Robert W. Jenkins

*Attorney, Agent, or Firm*—Paul H. Gallagher

[57] ABSTRACT

A conical spiral mixer with a conically tapered mixer container, includes a mixing spiral that moves parallel to the conical inner wall of the mixing container, the lower end of the mixing spiral extending through an opening in the container bottom below which is a swingable and pivotable bearing. The sealing between the shaft of the mixing spiral and the opening in the container bottom, is provided by means of a spherical sealing body pivotably supported on the shaft of the mixing spiral, but at an angle to the axis of the mixing container. The sealing body takes part in the swing movement of the shaft of the mixing spiral, but not however in its pivoting or spinning movement.

5 Claims, 4 Drawing Figures

CONICAL SPIRAL MIXER WITH SPHERICAL SEALING BODY IN THE BOTTOM OPENING

The invention concerns a conical spiral mixer of the general character shown in German published patent application 32 45 935.1, in the name of the present inventor as applicant. Such a mixer includes a mixing spiral, that is driven by a driver positioned under the mixing chamber, the drive being transmitted to the mixing spiral through a universal joint that is positioned outside of the mixing chamber. For sealing the lower end of the shaft and the elements thereon of the mixing spiral through the bottom opening in the mixer, there is provided a spherical sealing body, this feature being incorporated in German Pat. Nos. 1,956,007 or 2,701,799.

The disadvantage of the design of the above mentioned patents is that the spherical sealing body rotates with the mixing spiral shaft, with consequent rapid wear and tear of the opposed parts of the seal, i.e. on the housing of the mixer and on the shaft.

In the patent application identified above, namely No. 32 45 935.1, the spherical sealing body is pivotally mounted on the spiral shaft so that it essentially remains stationary, i.e. does not rotate, but only moves in the wobble movement of the spiral mixing shaft when the latter moves in its path which is parallel with the wall of the conical mixing container.

In previous devices, where the pivotal support of the spherical body was on the shaft of the mixing spiral, there was no feeding of lubricant into the support between the sealing body and the shaft because of certain materials being mixed, and under certain conditions, it happened on occasion that the sealing body would spin with the mixing spiral. An object of the present invention therefor is to provide a conical spiral mixer with a spherical sealing body at the bottom opening wherein oil or cooling medium or lubricant can feed into the support between the shaft of the mixing spiral and the sealing body.

In carrying out the objects of the present invention, the sealing body is secured against rotation with the spin of the mixing spiral, but is disposed at an angle to the axis of the mixing container so as to swing or wobble in a flange that is fixed to the mixing container.

In pointing up another feature of the invention, it is stated that because of the arrangement of the sealing body as just referred to, namely, it is fixed against rotation with the spin of the mixing spiral, but arranged for following a wobble movement, it is possible to feed lubricant and cooling mediums by way of flexible tubes into the bearing between the sealing body and the mixing spiral shaft, thereby extending the longevity of the bearing, but a high degree of security is maintained, namely that because the entire arrangement is disposed outside the mixing container, the lubricant and cooling mediums cannot escape from the bearing and contaminate the materials in the mixing container.

The device of the invention includes a novel design for providing the turning security referred to by providing in the sealing body, a set of levers or links which swing on axles that are perpendicular to the axis of the mixing spiral.

The device of the invention includes a very simple design form of component for preventing rotation of the sealing body, this component including said levers or links pivotally interconnected in a series, and interconnected between the sealing body and a fixed element of the device, which enables or accommodates wobbling movement of the sealing body in response to movement of the mixing spiral around the container.

The invention includes another advantageous feature, in that the arrangement of levers or links just referred to is adjustable, to accommodate lifting of the sealing body to different extents.

Another advantageous feature of the device of the invention is that the levers or arms are connected to the sealing body by means of a universal joint, thereby accommodating the tilting movement of the sealing body while the remaining part of the levers or arms accommodate height adjustment.

The objects of the invention do not arise from the individual patent claims alone, but from a combination of the different claims.

The invention includes as essential features, all of the specifications and characteristics of the device as disclosed herein as well as all of the interrelations of all of the elements disclosed.

Figure 1:
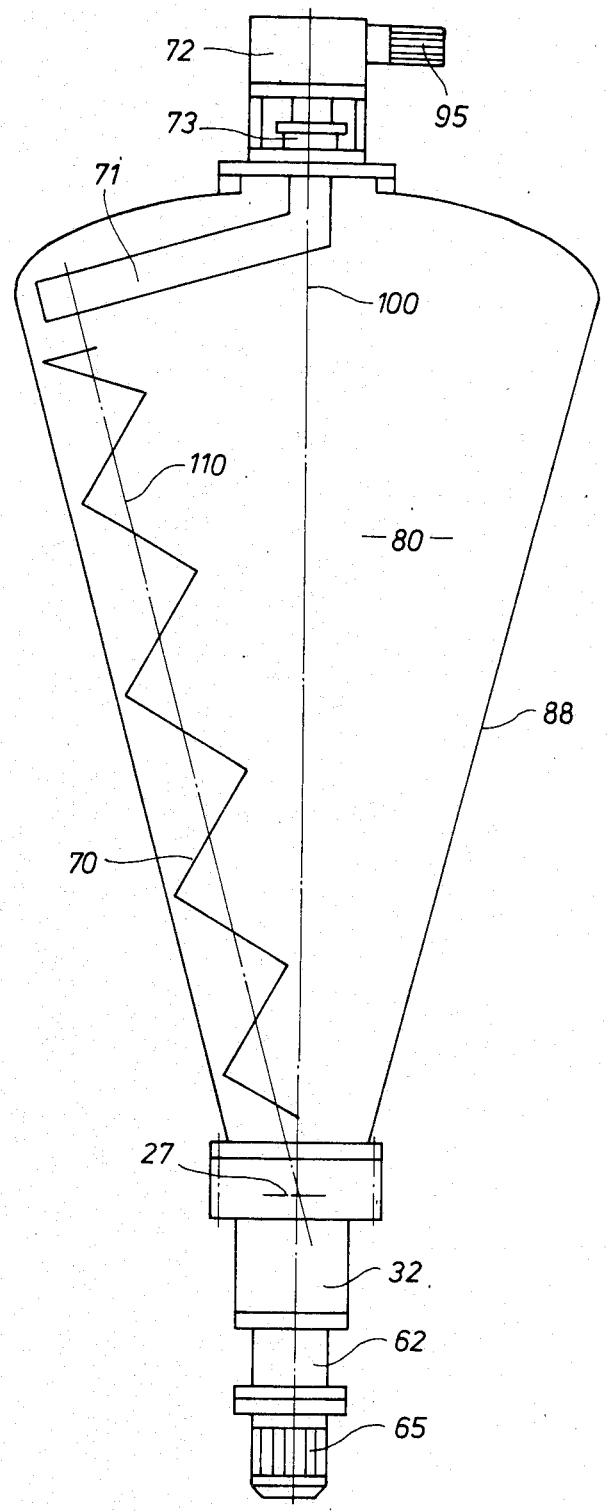
FIG. 1 is a schematic side view of a conical spiral mixer according to the invention.

FIG. 1 shows a mixing spiral 70 arranged in a mixing container that has a conical shape, tapering downwardly to the bottom, the spiral 70 turning at n1 around the axis 110 and at n2 around the container axis 100. The mixing spiral 70 is supported in its upper end in the free end of a driving arm 71, which is driven at an r.p.m. of n2 by means of a motor 95 and a gear case 72. At the top, the container lid is provided with sealing means 73, against the escape of the materials being mixed in the container.

Figure 2:
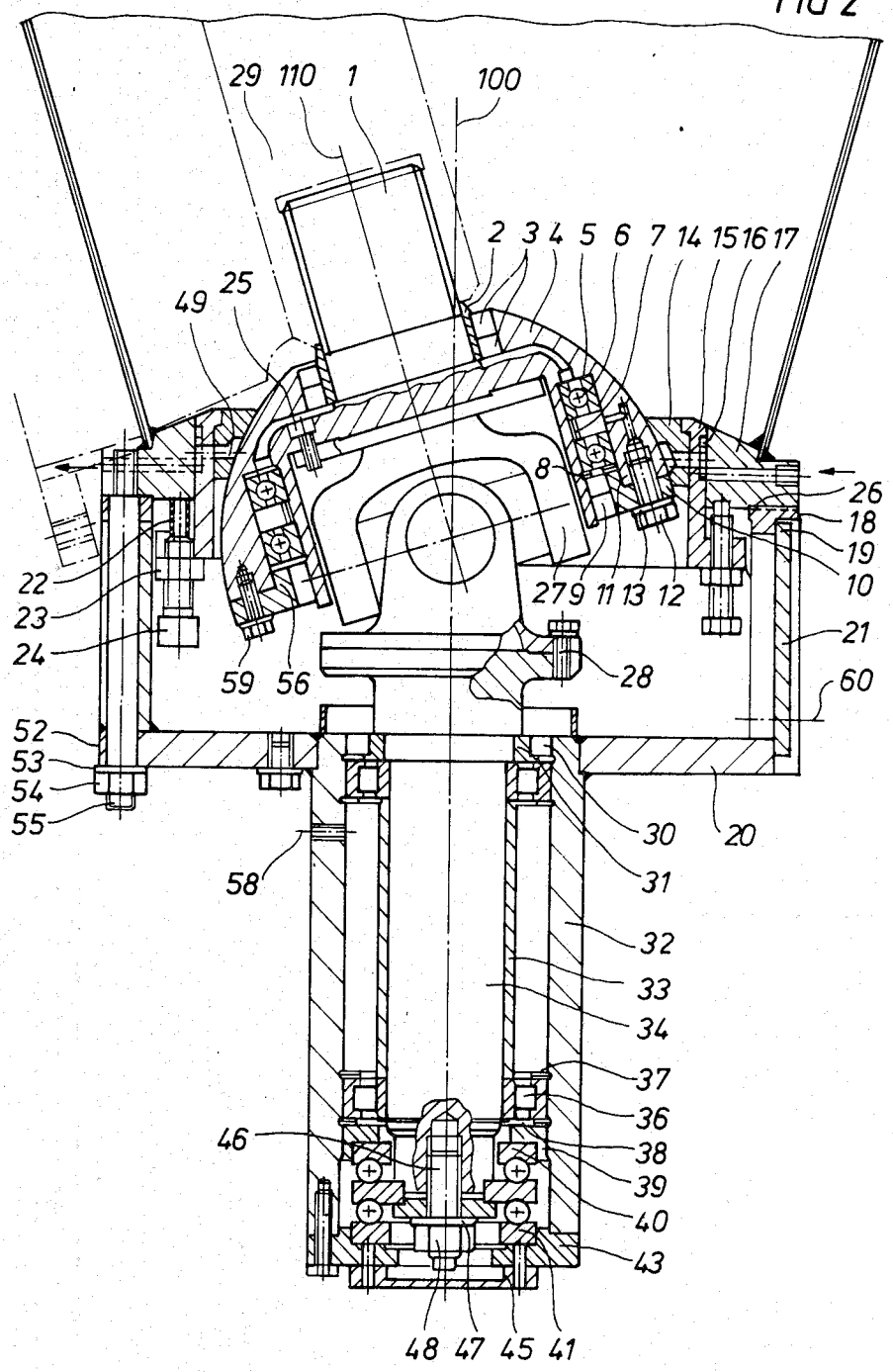
FIG. 2 is a cross section through the lower region of the mixer of FIG. 1 without the levers or arms.
Figure 3:
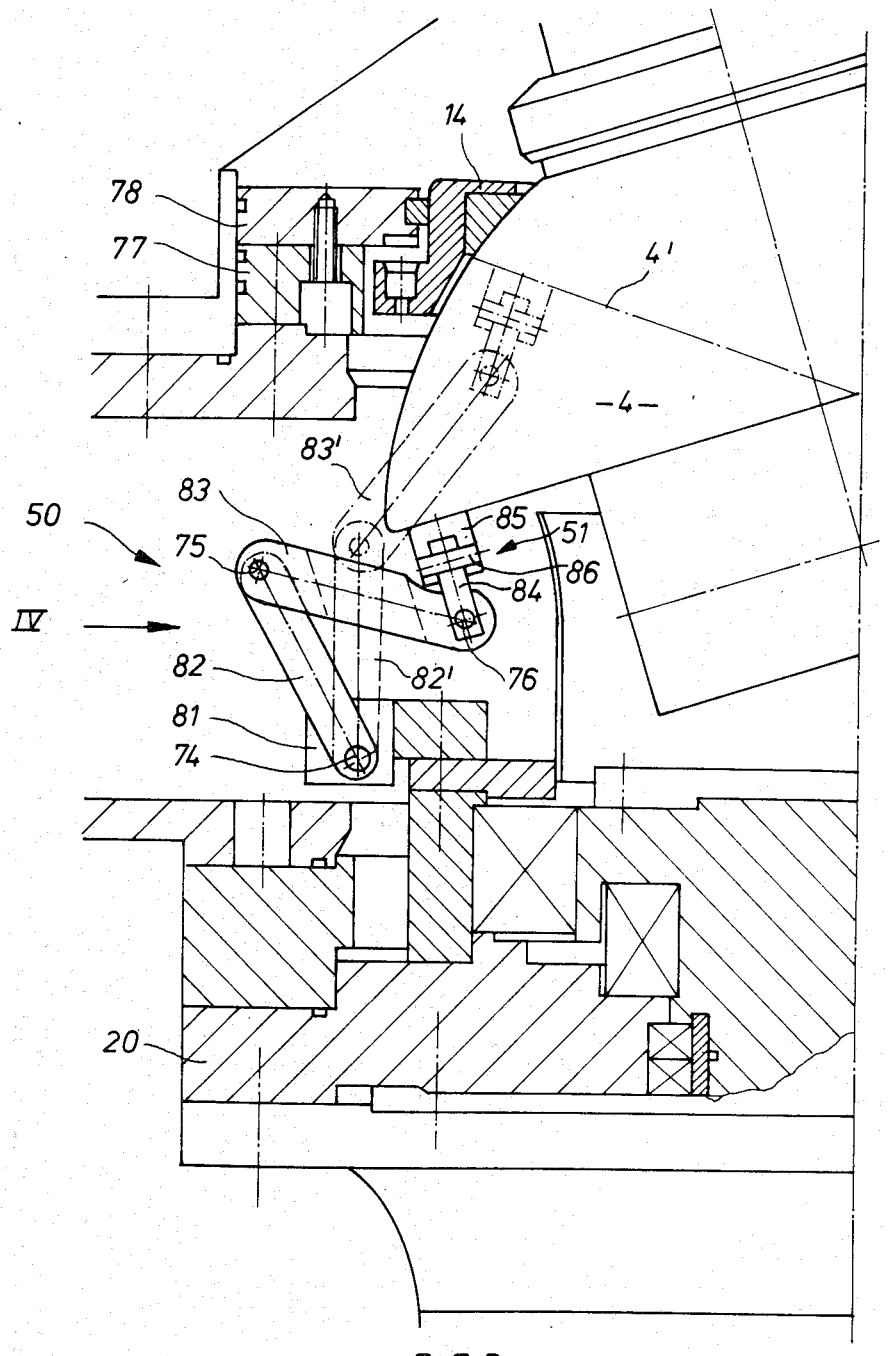
FIG. 3 shows the levers or arms for the sealing body, in two different height settings.

The lower end of the mixing spiral 70 is mounted, as shown in FIGS. 2 and 3 by means of a universal joint 27, whereby the mixing spiral received its drive, around the axis 110 by means of a shaft 34 leading from the universal joint, and supported in a hollow shaft 32. On the lower end of the shaft 32 is a flanged shank 62, on the bottom end of which is a drive motor 65.

As shown in FIG. 2, the mixing spiral 70 is secured as by welding to a coupling piece 29 with a female thread. In this coupling piece 29 is a screw bolt 1 so arranged that the thread tightens itself in operation, that is, according to the turning direction of the mixing spiral 70, a right or left hand thread is used.

Mounted on bolt 1 is a bushing 2. A bearing 6 and a bushing 7 are also mounted on the screw of bolt 1, as is a sealing ring 8. The screw in the bolt 1 is secured against rotation on the upper part of the universal joint 27 by means of screws 25, and the lower part of the universal joint is mounted against rotation on the shaft 34 by means of screws 28.

Disposed over the screw in the bolt 1 and the bushing 2 which is mounted thereon, the bearing 6, and the bushing 7 and sealing ring 8, as well as over the universal joint 27, is a hemispherical sealing body 4. Sealing means 3 is placed in position between the sealing body 4 and the screw in bolt 1 and held axially and radially by means of a flange 10 and sealing means 9 as well as supplemental rings 5.

A sealing effect is produced by an O-ring 56 and the flange is secured in place by means of screws 59. Lubrication of the bearing can be produced by way of the blind screw 12 of the washer 13 or by way of constant feeding lubricant and cooling mediums by way of a flexible hose, not shown, which may be put in place instead of the screw 12. Additional sealing effect is guaranteed by means of an O-ring 11. The construction and assembly just referred to, assures that because the center of the universal joint 27, as well as the sealing body 4, are at a common point, the arrangement accommodates inclination as much as 25° to the vertical axis 100.

On the shaft 34 of the universal joint 27, is a bushing 31, mounted against rotation. Additionally, the inner ring of the bearing 36 as well as the tube 33 are mounted on the shaft 34 and secured by means of a sealing ring 38. The shaft 34 is provided with varying centers for the bearing as well as with square thread tenon 46.

The housing for supporting the container includes a pipe housing 18, a flange 52 opposed thereto, as well as a hollow shaft 82, these being welded together. The pipe housing 18 is provided with a plurality of assembly and control openings, which are normally closed by covers 21, diposed at the circumference of the housing and having screws 60 and sealing rings 19.

Into the hollow shaft 32 the outer rings of the bearing 36 are shoved and secured against axial displacement relative to the sealing rings 37. Then a support flange 43 as well as a two-sided axial support 40 are shoved into the hollow shaft 32. Thereafter the support flange 43 with the O-ring 42 is shoved into the hollow shaft 32 respectively, by way of the outer ring of the support 40 and bound securely therein by means of the screws 60.

Thereafter the shaft 34 of the universal joint is shoved in place by means of the tension washer 41, a spring washer 47 and the female thread screw 48, and the shaft 34 is bound securely with the axial bearing.

The securement of the mixing spiral 70 with the screw in bolt 1 is made by turning the square of the shaft 34 of the universal joint, whereby the coupling piece 29 screws into the thread of the bolt 1. This can be done without dismantling the support assembly. After completion of this step, the support flange 43 is closed by the lid 45.

The support housing is secured against pivoting on the container bottom by means of the threaded bolts 55, female threads 54 and spring washers 53, and sealed with an O-ring 26. The seal between the sealing body 4 and the container bottom 17 is made by means of a sealing flange 14 and a stand flange 15 by means of an O-ring 16.

The material of the sealing flange 14 may be of Teflon (registered trademark of DuPont) or some other side bearing material. The material of the sealing body 4 is of hardened steel material, or other similar material suited to cooperation with the sealing flange 14. The sealing flange 14 has an inner clearing ring 49 which is provided with an inflow or outflow bore which is bored through the stand flange 15. The bores in the flanges 14, 15 are in register as an inlet or outlet bore in the container bottom 17.

The point flange is secured against turning by means of a screw bolt which lock nuts. In the stand flange 15 a plurality of spring loaded relay screws 24 are fixedly secured to opposed female screws 23 and the springs 22, these relay screws 24 pressing the stand flange 15 with sealing flange 14 downward toward the sealing surface of the sealing body 4.

A cleaning ring 49, shown in FIG. 2, makes it possible to clean the sealing body 4 or the sealing flange 14 without dismantling the bearing. Furthermore this cleaning ring 49 can be used in a cooling step for the sealing body 4.

The air space between the sealing flange 14 and the sealing body 4 and the support housing 18, 52, 32 acts as an insulation layer. Additionally, the universal joint 27 and the sealing ball parts can be cleaned with cooling fluids or gases. A cover 21 provides access for ingress or egress of a cooling fluid.

Figure 4:
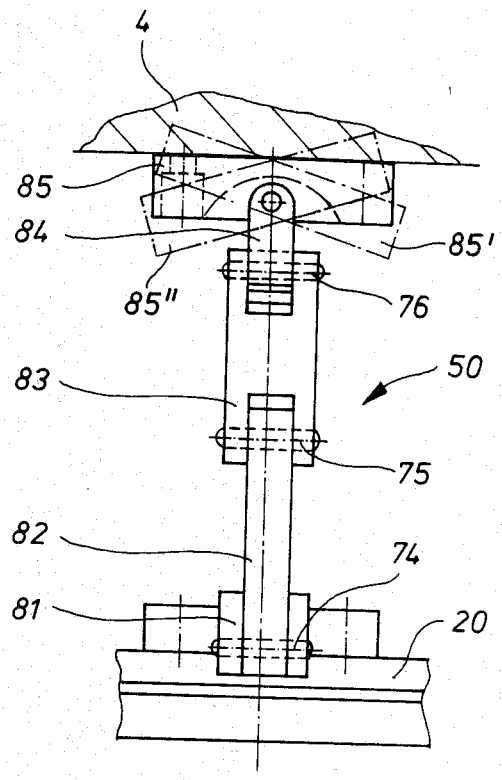
FIG. 4 is a view of a portion of FIG. 3 shown in the direction of the arrow IV.

FIGS. 3 and 4 illustrate what is referred to as a set of levers or arms, or swing gear, 50, which consists of an assembly plate 81, mounted on a flange 20 fixed to the housing, and an arm or link 82 is mounted thereon by means of an axle 74. The other end of the arm 82 is connected to a second arm 83 by means of a second axle 75, and the arm 83 is secured at its opposite end with an end of a bolt 84 by means of a third axle 76. The bolt 84 is an element of a universal joint 51, which is also mounted on the underside of the sealing body 4. The bolt 84 is thereby revolvably supported perpendicular to a cross bolt 86, which in turn is revolvably supported on an axis perpendicular to the bolt 84 in a bushing 85, the bushing being secured to the underside of the sealing body 4.

Thus, according to FIGS. 3 and 4, it is seen that the sealing body 4 moves through only swinging movements and the swing gear 50 when extended, assumes a position shown in dot-dash lines in FIG. 3, the arrangement being that in response to the sealing body 4 moving into its position 4' the arms assume corresponding positions 82', 83'.

Opposite the sealing flange 14, i.e. radially outwardly therefrom, a sealing flange 78 is positioned, at the housing side, i.e. adjacent the housing, which is fastened to a support flange 77.

FIG. 4 shows corresponding wobble movements of the sealing body 4, and in such movements, the bushing 5 assumes corresponding positions 85' or 85''.

The swing bearing 50 of the sealing body, as described above, is a significant advantage relative to devices heretofore known because in such devices the friction forces between the sealing body 4 and the sealing flange 14 must always have been greater than the friction forces arising from the bearing 6 and from the sealing means 3 and 9.

I claim:

1. A conical spiral mixer with a mixing container tapering conically toward the bottom, in which is arranged a mixing spiral parallel with the tapered wall of the mixing chamber, and rotating on its own internal axis, the container having a support at its lower end, the support including a movably spherical sealing body and sealing means sealing the sealing body, the sealing body including a mounting element extending into interior of the container, and the mixing spiral has an axle mounted on said mounting element, and the mixing spiral being thereby mounted on the sealing body and mounted in said support, characterized in that, the mixing spiral being mounted on said mounting element for rotation, as stated on its internal axis, the sealing body is mounted and supported with its center positioned stationary in the central axis of the mixing container, and is swingable at an angle to said axis of the mixing container and in an element fast in the support of the mixing container.

2. A conical spiral mixer according to claim 1 and including, turning safety mechanism and swivel support for the sealing body including a swing gear which itself includes plurality of links connected together longitudinally serially and connected to and between the sealing body and said support on axes perpendicular to said internal axis of the mixing spiral.

3. A conical spiral mixer according to claim 2 wherein, said swing gear includes a first link having a first end pivoted on a fixed axis on said support, and its second end pivoted in a first end of a second link, and the second link has its second end pivoted on the sealing body.

4. A conical spiral mixer according to claim 3 wherein, said swing gear is adjustable in length.

5. A conical spiral mixer according to claim 2 and including, a universal joint interconnecting the said second link and the sealing body, and said universal joint includes a bolt parallel with the axis of the mixing spiral, pivotally mounted on a bolt on the sealing body on an axis perpendicular to the axis of the mixing spiral.

* * * * *